US005592880A

United States Patent [19]

Rodi

[11] Patent Number: 5,592,880

[45] Date of Patent: Jan. 14, 1997

[54] METHOD OF SUPPLYING OR FEEDING DAMPENING SOLUTION

[75] Inventor: Anton Rodi, Leimen, Germany

[73] Assignee: Heidelberger Druckmaschinen, Heidelberger, Germany

[21] Appl. No.: 407,167

[22] Filed: Mar. 21, 1995

Related U.S. Application Data

[63] Continuation-in-part of Ser. No. 175,946, Dec. 30, 1993, abandoned.

[51] Int. Cl.[6] ..... B41F 7/24; B41F 7/26

[52] U.S. Cl. ..... 101/450.1; 101/148

[58] Field of Search ..... 101/147, 148, 101/350, 366, 365, DIG. 45, 450.1

[56] References Cited

U.S. PATENT DOCUMENTS

| | | | |
|---|---|---|---|
| 4,000,692 | 1/1977 | Wirz et al. . | |
| 4,140,056 | 2/1979 | Mabrouk . | |
| 4,565,450 | 1/1986 | Wirz et al. | 101/148 |
| 4,722,274 | 2/1988 | Jeschke et al. . | |
| 4,899,653 | 2/1990 | Michl et al. | 101/148 |
| 4,991,502 | 2/1991 | Akao . | |
| 5,050,994 | 9/1991 | Kipphan et al. . | |
| 5,081,926 | 1/1992 | Rodi . | |

FOREIGN PATENT DOCUMENTS

| | | |
|---|---|---|
| 3326698 | 2/1985 | Germany . |
| 3907584 | 9/1990 | Germany . |

*Primary Examiner*—J. Reed Fisher

*Attorney, Agent, or Firm*—Herbert L. Lerner; Laurence A. Greenberg

[57] ABSTRACT

Dampening solution is supplied to a printing form of an offset printing press. The quantity of dampening solution is alternatingly varied about a preselectable mean value between a minimum value and a maximum value. The variation is independent of possible fluctuations due to deviations in the controlled supply of dampening solution. The mean, minimum and maximum values are defined from an ink distribution on a printed subject.

7 Claims, 2 Drawing Sheets

METHOD OF SUPPLYING OR FEEDING DAMPENING SOLUTION

CROSS-REFERENCE TO RELATED APPLICATION

This is a continuation-in-part of application Ser. No. 08/175,946, filed Dec. 30, 1993, now abandoned.

BACKGROUND OF THE INVENTION

Field of the Invention

The invention relates to a method of supplying or feeding dampening solution to a printing form of an offset printing press.

In offset printing with offset printing presses, it is necessary to feed ink and dampening solution to the printing form. This is accomplished with so-called inking and dampening units, respectively. The dampening solution is preferably treated water, mixed with dampening-solution additives as well as a share of alcohol. An arrangement of rollers in the dampening unit ensures that the dampening solution is applied to the printing form in as uniform a distribution as possible in order to form a thin dampening-solution film. Particularly considering the present-day striving for increased productivity in printing and the use of less-experienced pressmen, it is becoming ever more important that the production process should be stable, simple and problem-free. One of the dreaded troubles is so-called emulsification in the inking unit, which may occur particularly in the case of unevenly structured printing subjects and/or lengthy production processes. It has become known heretofore that, even if the sheet is completely printed with ink, the conventional offset printing process requires a component or share of dampening solution. This is, for example, because of the non-printed margins and, also, in order to stabilize the transfer process. The quantity of dampening solution required therefor is relatively large. In contrast therewith, non-printed image areas require a smaller component or share of dampening solution. If printing is performed with the same subject over a lengthy period of time, it is then possible for problems to occur, as shown in practice; in particular, the aforementioned emulsification may occur, the only recourse to which then being the time-consuming cleaning of the inking unit. The production process becomes particularly sensitive when only small areas or even just lines are being printed.

Published Non-prosecuted German Application 40 28 083 discloses a method of controlling dampening in offset printing presses wherein, during the production run, the smear limit is reached at intervals, with the actual value measured at the smear limit being used as the setpoint value for the following controlling of the quantity of dampening solution.

It is accordingly an object of the invention to provide a method of feeding dampening solution of the foregoing general type, which avoids emulsification in the inking unit, particularly in the case of unevenly structured subjects and/or lengthy production processes.

SUMMARY OF THE INVENTION

With the foregoing and other objects in view, there is provided, in accordance with the invention, a method of supplying dampening solution to a printing form of an offset printing press, which comprises:

selecting a mean value of a quantity of dampening solution to be supplied to a printing form;

determining a maximum value above the mean value and a minimum value below the mean value;

supplying a quantity of dampening solution and selectively fluctuating the quantity about the mean value alternatingly between the minimum value and the maximum value, independently of possible fluctuations due to deviations in a control of a dampening solution supply.

The supply control referred to is generally a feedback control.

The basic idea of the invention, therefore, is in alternating about a mean value between overdampening and underdampening. By thus alternating the amount of dampening solution being fed or supplied, it is clear that the rate of feeding is not constant, but rather, varies with respect to time as a function of, or depending upon, defined parameters. This type of supplying or feeding results in a reduction in the quantity of dampening solution which is required, in comparison with the heretofore known type of supplying or feeding, which is virtually constant across the breadth or width. Excess dampening solution during "overdampening", i.e., when the quantity supplied is above the mean value, is equalized in accordance with the invention in the inking/dampening unit. An important concept of the invention is this quasi automatic equalization of the dampening solution in the inking-unit/dampening-unit system. The method according to the invention results in a stable printing process, even in the case of lengthy production intervals, without any occurrence of emulsification, or wherein the risk of emulsification is greatly reduced. The printing process is relatively simple to supervise and control, and it is trouble-free.

In accordance with another mode of the method according to the invention, the offset printing press includes an inking unit and a dampening unit, and at least one of the mean value, the minimum value, the maximum value and an adjustable frequency of alternating the supplying of the dampening solution is selected so that excess dampening solution is equalizingly distributable in at least one of the inking unit and the dampening unit of the printing press.

In accordance with a further mode, the method of the invention includes selecting at least one of the mean value, the minimum value, the maximum value and the frequency depending upon the variation of a printed subject over at least one of the length and breadth of a printed image.

In accordance with an added mode, the method of the invention includes selecting the minimum value so that it corresponds approximately to a supplied quantity necessary for continuously supplying dampening solution for a completely printed area of a printed image.

In accordance with an additional mode, the method of the invention includes selecting the maximum value so that it corresponds approximately to a supplied quantity necessary for continuously supplying dampening solution, depending upon a variation of the printed subject.

In accordance with yet another mode of the method according to the invention, the offset printing press has a dampening unit with a dampening-duct roller, and the supplying of dampening solution is controlled/regulated by adjusting the rotational speed of the dampening-duct roller.

In accordance with a concomitant mode of the method according to the invention, the offset printing press has a dampening unit with a dampening-solution metering roller, and the supplying of dampening solution is controlled/regulated by adjusting the rotational speed of the dampening-solution metering roller. Suitable control and measurement systems in this regard are known in the art, for instance from U.S. Pat. No. 4,991,502.

Thus, as noted hereinbefore, in accordance with the invention, the feeding or supplying of dampening solution is alternated about the mean value thereof between a minimum value and a maximum value. The magnitudes of the minimum and maximum values, i.e., the amplitudes thereof, are dependent upon the gradation or variation of the printed subject over the length and width or breadth of the printed image. This applies also to the choice of the mean value.

Furthermore, the frequency of the alternation between overdampening and underdampening is likewise dependent upon the gradation or variation of the printed subject over the length and width of the printed image.

The aforementioned parameters (mean value, minimum value, maximum value and/or frequency) of the alternating dampening-solution supply are preferably selected so that excess dampening solution, i.e., dampening solution which is not required instantaneously in the printing process, can be equalizingly distributed in the inking unit and/or dampening unit of the printing press.

It is particularly advantageous if the maximum value corresponds approximately to a supplied quantity of dampening solution which would be required for continuous, i.e., conventionally known, dampening-solution supplying of a completely printed area of the printed image.

Likewise, it is advantageous if the minimum value corresponds approximately to a supplied quantity Of dampening solution which would be required for the conventional continuous supplying of dampening solution, as a function of or depending upon the gradation or variation of the printed subject. The pressman can, therefore, on the basis of his previous knowledge, determine the minimum value, and the maximum value for process control according to the invention and, in order to set or adjust to the maximum value, can select the supplied quantity that would be required for a completely printed area with a virtually constant feeding or supplying of dampening solution across the width of the printed image. In order to set or adjust to the minimum value, the pressman selects the supplied quantity which, depending upon the gradation or variation of the printed subject, would be required if the feeding or supplying of the dampening solution were not in accordance with the invention, but rather, in accordance with the conventional manner of supplying the dampening solution virtually constantly across the width or breadth of the image.

Basically, it should be noted here that the conventional continuous dampening-solution supply method, of course, also leads to fluctuations in the supplied quantity because, for example, if the dampening-solution supply is feedback-controlled, fluctuations alternating about a "mean value" will occur within the control range. Such fluctuations in the quantity of dampening solution are not comparable with the alternations in the feeding or supplying of dampening solution intentionally provided in accordance with the invention. If the application of the method according to the invention is simultaneously combined with a feedback control, then there will be small control fluctuations in the dampening-solution feed or supply, with the alternating overdampening and underdampening conditions according to, the invention being superimposed on the control fluctuations.

The alternating supplying or feeding of the dampening solution about the mean value may preferably be controlled/regulated by adjusting the rotational speed of a dampening duct roller, by adjusting the rotational speed of a dampening-solution metering roller and/or a like device and process control, respectively, of the dampening unit of the offset printing press. Disclosed herein are merely examples of how to practise the method according to the invention and provide varying supplied quantities of dampening solution in accordance with the invention, however, the invention, of course, is not restricted to the foregoing examples. The invention also encompasses any other devices and procedures which permit an alternating supplying or feeding of dampening solution.

Other features which are considered as characteristic for the invention are set forth in the appended claims.

Although the invention is illustrated and described herein as a method of feeding dampening solution, it is nevertheless not intended to be limited to the details shown, since various modifications and changes may be made therein without departing from the spirit of the invention and within the scope and range of equivalents of the claims.

The construction and method of operation of the invention, however, together with additional objects and advantages thereof will be best understood from the following description of specific modes thereof when read in connection with the accompanying drawings.

DESCRIPTION OF A PREFERRED EMBODIMENT

Figure 1:
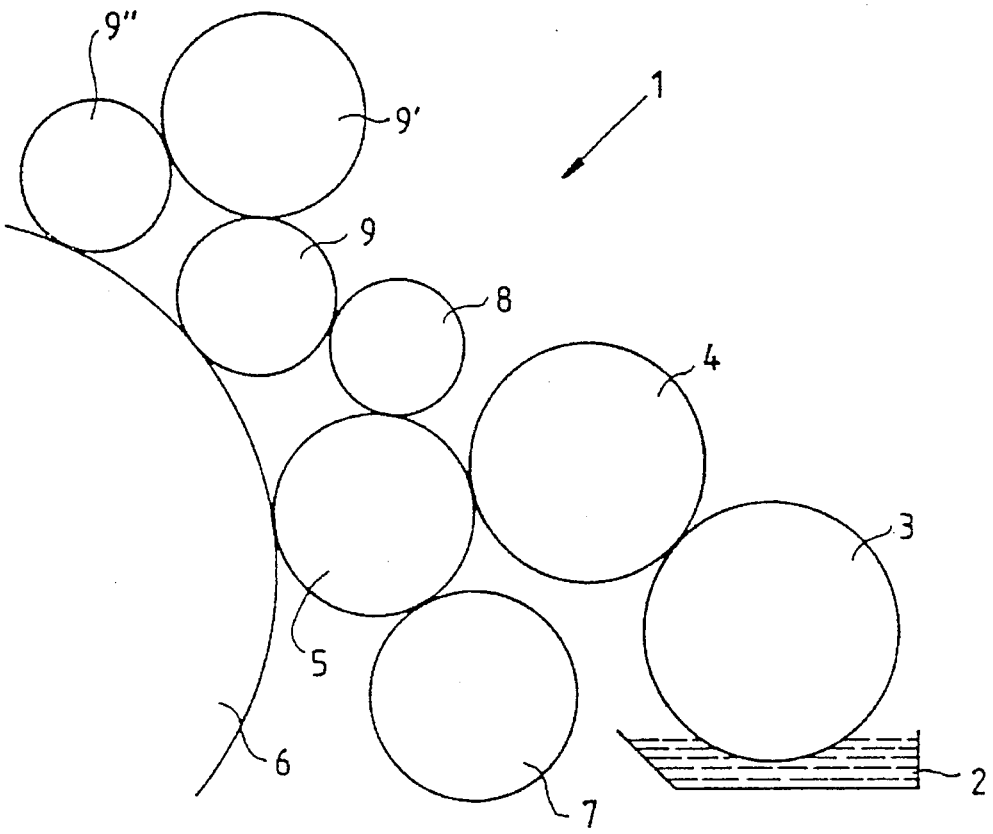
FIG. 1 is a diagrammatic side elevational view of a dampening unit of an offset printing press suitable for practicing the method according to the invention.

Referring now to the drawings in order to explain the method according to the invention and, first, particularly to FIG. 1 thereof, there is shown therein a dampening unit 1 of an otherwise non-illustrated offset printing press, the dampening unit 1 being formed of a multiplicity of rollers and cylinders. Partly immersed in a dampening-solution reservoir 2 is a portion of the circumference of a dip roller 3 which cooperates with a metering roller 4. The dip roller 3 has a rubber surface, which is cambered or convexly ground. The metering roller 4 has a smoothly chrome-plated surface.

Cooperating with the metering roller 4 is a dampener roller or dampening form or applicator roller 5 which comes into contact with a non-illustrated printing form on a plate cylinder 6 during the printing process. In contact with the dampening form roller 5 is a dampening distributor roller 7, which has a matt chrome-plated surface The surface of the dampening form roller 5 is formed of rubber. A so-called intermediate roller 8 with a surface formed of Rilsan, a trade name for polyamide synthetics, cooperates with a plate-inking or ink form roller 9, which forms part of the inking unit of the offset printing press, only two additional rollers 9' and 9" of the inking unit being illustrated in FIG. 1.

Metering of a quantity of the dampening solution in order to adjust the thickness of the dampening solution film on the non-illustrated printing form of the plate cylinder 6 is possible by suitably varying the rotational speed of the metering roller 4. Furthermore, the required quantity of dampening solution can be regulated, and especially finely regulated, also through the relative speed and adjustment of the metering roller 4 with respect to the dampening roller 5.

Figure 2:
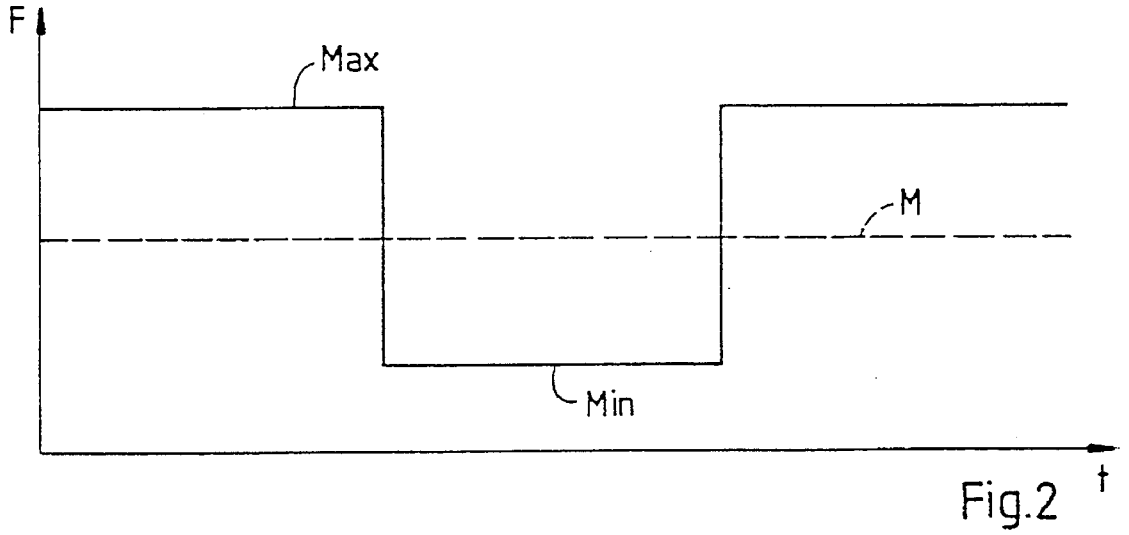
FIG. 2 is a plot diagram illustrating the quantity of dampening solution being fed as a function of time.

According to the invention, the dampening solution is not supplied continuously, as in conventional arrangements, but at different amplitudes or quantities as a function of time, which is apparent from FIG. 2.

FIG. 2 shows a rectangular plot diagram having an ordinate along which the quantity of dampening solution is plotted, and an abscissa along which the time t is plotted. As is readily apparent, the quantity of dampening solution which is supplied alternates about a mean value M, between either a maximum value Max or a minimum value Min. In FIG. 2, the change from the maximum value Max to the minimum value Min and from the minimum value Min to the maximum value Max is abrupt. This is not actually necessary and, in accordance with other different modes of supplying the dampening solution, it is also possible to vary the quantity supplied steadily and gradually between maximum Max and minimum Min values. The settings or adjustments of the mean value M, the maximum value Max, the minimum value Min, i.e., the amplitudes or amounts of the dampening solution, as well as the frequency of the alternating dampening-solution supply are determined by the pressman depending upon the gradation or variation of the printed subject over, the length and breadth of the printed image. For a coarse setting, the pressman selects a minimum value Min corresponding approximately to a supplied quantity of dampening solution which would be necessary for continuously supplying dampening solution for a completely printed area of the printed image. The pressman selects the maximum value Max corresponding to a supplied quantity which would be necessary for continuously supplying dampening solution conventionally, depending upon the subject. Additionally or alternatively, the quantities for the maximum value Max, the minimum value Min and the mean value M are also attainable, depending upon the subject, by an open-loop or feedback control, i.e., control and regulation, respectively, for example by means of determinable relationships from values obtained by a plate reader. Plate readers are known, for instance, by the designation CPC 3 of Heidelberger Druckmaschinen AG, Germany. It is also possible to employ a densitometer or colorimeter, the measurement results of which are subjected to as-determined relationships so as to arrive at the aforementioned values for the maximum and minimum ink-supply quantities. It has been found in particular that the mean value M and the frequency of alternation in the dampening-solution feed are especially dependent upon the variation of the printed subject over the length and breadth of the respective printed image.

Even an only approximately selected setting of the aforementioned values will, with a properly performed printing process, considerably reduce the component share of dampening solution leading to emulsification, thereby permitting the performance of long-lasting, optimal printing processes.

EXAMPLE

Figure 3A:
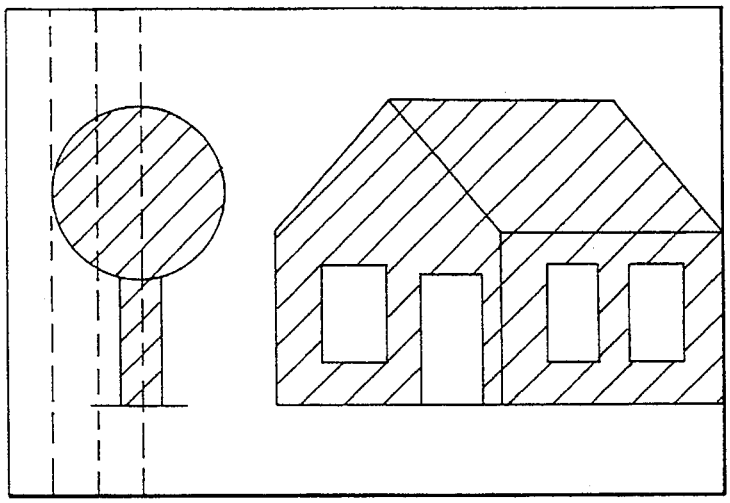
FIG. 3*a* is a plan view of an exemplary subject image.
Figure 3B:
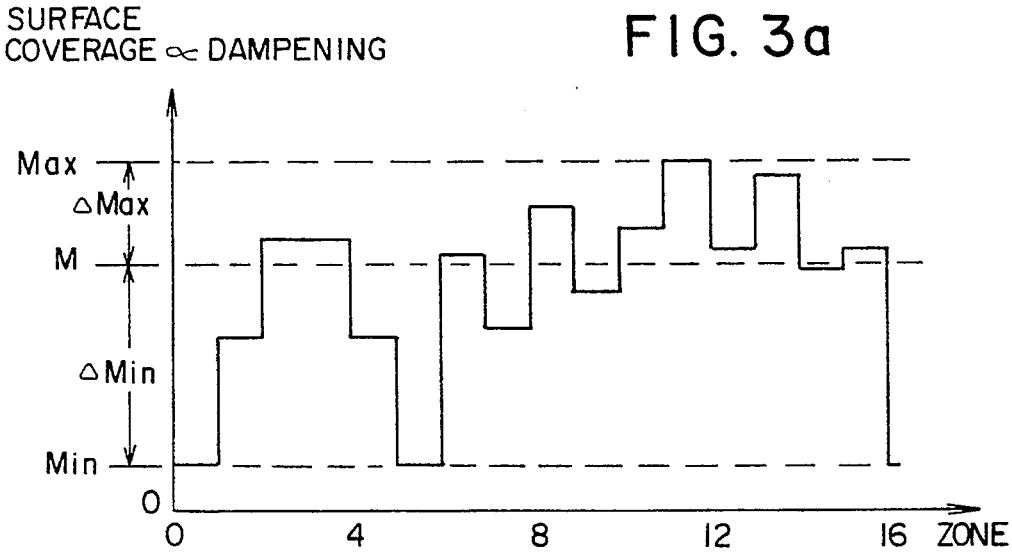
FIG. 3*b* is a plot diagram indicating inking amount over a zonal distribution across the subject of FIG. 3*a*.
Figure 3C:
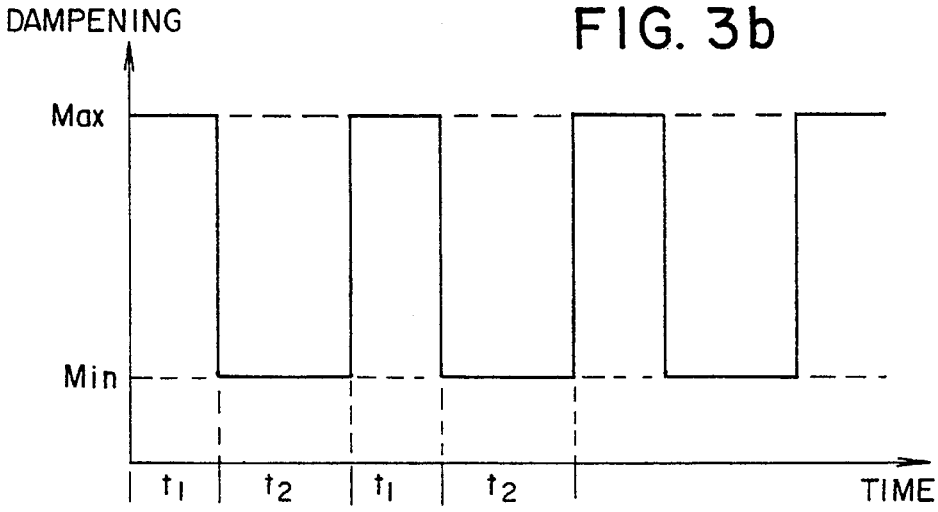
FIG. 3*c* is exemplary plotted fluctuation of dampening medium supply between maximum and minimum values.

Particularly with reference to FIGS. 3*a*–3*c*, the zonal ink coverage is defined on a subject 10. The coverage distribution is plotted on a diagram 11 with an ordinate defining the inking amount and the abscissa defining the zonal distribution along one of the coordinate axes of the subject. The zonal coverage values are proportional to the damping and they extend between the minimum value Min and the maximum value Max. The mean value M is calculated from the distribution about the entire subject. The profile plotted in FIG. 3*b* corresponds to the desired distribution at the applicator roller on the plate cylinder.

The mean value M is the indicator for the constant damping solution adjustment as it is conventionally applied. The differential values ΔMin and ΔMax are calculated from the difference between the values M-Min and Max-M, respectively.

The diagram of FIG. 3*c* illustrates an exemplary fluctuation of the damping from the mean M, between the maximum value Max (obtained in FIG. 3*b*) and the minimum value Min. The duty factor (i.e. the ratio between $t_1$ and $t_2$) of the fluctuating damping is obtained from the ratio between ΔMin and ΔMax (i.e. $t_1/t_2=\Delta Max/\Delta Min$). It should be noted, however, that the fluctuations about the average M may also be asymmetric. Furthermore, the function which defines fluctuations of the damping application may be arbitrarily chosen from a number of duty cycles, including the illustrated saw-tooth curve, a steep-slope triangular curve, a trapezoidal curve, a sinusoidal function, or the like. Ink profiles across the subject may be obtained with conventional measures. Reference is had, for instance, to my earlier disclosure in U.S. Pat. No. 5,081,926 or to U.S. Pat. No. 4,722,274 to Jeschke et al.

I claim:

1. A method of supplying dampening solution to a printing form of an offset printing press, which comprises:

selecting a mean value of a quantity of dampening solution to be supplied to the printing form, the mean value being selected on the basis of an adjustable minimum value and an adjustable maximum value;

determining the maximum value above the mean value and the minimum value below the mean value;

supplying a quantity of dampening solution, and selectively fluctuating the quantity about the mean value alternatingly between the minimum value and the maximum value independently of possible fluctuations due to deviations in a control of a dampening solution supply.

2. The method according to claim 1, wherein the offset printing press includes an inking unit and a dampening unit, and wherein the step of fluctuating includes fluctuating at an adjustable frequency, and the method further comprises selecting at least one of the minimum value, the maximum value and the adjustable frequency of alternating the supplying of the dampening solution such that excess dampening solution is equalizingly distributable in at least one of the inking unit and the dampening unit of the printing press.

3. The method according to claim 1, wherein the step of fluctuating includes fluctuating at an adjustable frequency, and the method further comprises selecting at least one of the minimum value, the maximum value and the adjustable frequency depending upon a variation in an ink distribution on a printed subject over at least one of the length and breadth of a printed image.

4. The method according to claim 1, which includes selecting the minimum value so that it corresponds approximately to a supplied quantity necessary for continuously supplying dampening solution for a completely printed area of a printed image.

5. The method according to claim 1, which includes selecting the maximum value so that it corresponds approximately to a supplied quantity necessary for continuously supplying dampening solution, depending upon a variation in an ink distribution on the printed subject.

6. The method according to claim 1, wherein the offset printing press has a dampening unit with a dampening-duct roller, and wherein the method further comprises controlling/regulating the supplying of dampening solution by adjusting a rotational speed of the dampening-duct roller.

7. The method according to claim 1, wherein the offset printing press has a dampening unit with a dampening-solution metering roller, and wherein the method further comprises controlling/regulating the supplying of dampening solution by adjusting a rotational speed of the dampening-solution metering roller.

* * * * *

UNITED STATES PATENT AND TRADEMARK OFFICE

CERTIFICATE OF CORRECTION

PATENT NO. : 5,592,880
DATED : January 14, 1997
INVENTOR(S) : Anton Rodi

It is certified that error appears in the above-indentified patent and that said Letters Patent is hereby corrected as shown below:

On the title page, insert
Item (30) Foreign Application Priority Data should read as follows:

| | | | |
|---|---|---|---|
| December 30, 1992 | (DE) | Germany | P 42 44 500.0 |

Signed and Sealed this
Tenth Day of June, 1997

Bruce Lehman

*Attest:*

BRUCE LEHMAN

*Attesting Officer*

*Commissioner of Patents and Trademarks*